US011851892B2

(12) United States Patent
Pegoraro

(10) Patent No.: US 11,851,892 B2
(45) Date of Patent: Dec. 26, 2023

(54) MODULAR SUPPORTING ELEMENT FOR MAKING RAISED AND/OR VENTILATED REINFORCED CONCRETE FLOORS

(71) Applicant: Geoplast SpA, Grantorto (IT)

(72) Inventor: Mirco Pegoraro, Grantorto (IT)

(73) Assignee: GEOPLAST SPA, Grantorto (IT)

( * ) Notice: Subject to any disclaimer, the term of this patent is extended or adjusted under 35 U.S.C. 154(b) by 115 days.

(21) Appl. No.: 17/601,083

(22) PCT Filed: Mar. 20, 2020

(86) PCT No.: PCT/IB2020/052595

§ 371 (c)(1),
(2) Date: Oct. 4, 2021

(87) PCT Pub. No.: WO2020/201881

PCT Pub. Date: Oct. 8, 2020

(65) Prior Publication Data

US 2022/0162863 A1 May 26, 2022

(30) Foreign Application Priority Data

Apr. 5, 2019 (IT) ..... 102019000005204

(51) Int. Cl.
*E04F 15/12* (2006.01)

(52) U.S. Cl.
CPC ..... *E04F 15/123* (2013.01)

(58) Field of Classification Search
CPC ..... E04F 15/02464; E04F 15/02447; E04F 15/02452; E04F 15/02458; E04F 15/02494; E04F 15/123; E04F 2290/02; E04B 5/32; E04B 5/36; E04B 5/43; E04B 5/48; E04B 2005/324
See application file for complete search history.

(56) References Cited

U.S. PATENT DOCUMENTS 4,922,670 A * 5/1990 Naka ..... E04F 15/02458 52/126.6
5,791,096 A * 8/1998 Chen ..... E04F 15/02452 52/220.1

(Continued)

FOREIGN PATENT DOCUMENTS

AT 509463 A4 9/2011
EP 1605113 A1 12/2005

*Primary Examiner* — Jessica L Laux
(74) *Attorney, Agent, or Firm* — Carmel Patent Agency LLC; Robert J. Ballarini

(57) ABSTRACT

A supporting element for cylindrical or column-shaped elements of modular elements for making raised and/or ventilated floors, includes a substantially plane base configured to be rested on the underlying floor, two or more lateral extensions arranged at sides of the plane base and coplanar with the plane base, coupling elements arranged on the portions of said lateral extensions that are far from the plane base. The supporting element includes a first series of projections arranged along a circle centered on the plane base, defining a seat in which a lower end of the cylindrical or column-shaped elements is inserted and housed, and wherein the projections of the first series are configured to adhere to the surface of the cylindrical or column-shaped element housed in the seat.

9 Claims, 13 Drawing Sheets

(56) References Cited

U.S. PATENT DOCUMENTS

| | | | | |
|---|---|---|---|---|
| 6,332,292 | B1 * | 12/2001 | Buzon | E04F 15/02482 248/351 |
| 7,650,726 | B2 * | 1/2010 | Jakob-Bamberg | E04B 5/48 52/220.1 |
| 8,898,999 | B1 * | 12/2014 | Kugler | E04F 15/02464 52/126.6 |
| 9,879,385 | B2 * | 1/2018 | Tabibnia | E04F 15/02452 |
| 2008/0222973 | A1 * | 9/2008 | Lee | E04F 15/02488 52/126.6 |
| 2017/0152635 | A1 | 6/2017 | Tabibnia | |

* cited by examiner

MODULAR SUPPORTING ELEMENT FOR MAKING RAISED AND/OR VENTILATED REINFORCED CONCRETE FLOORS

FIELD OF THE INVENTION

The present invention concerns elements for making raised and/or ventilated floors, and more specifically it concerns modular supporting elements for making raised and/or ventilated floors on columns.

BACKGROUND

Disposable preformed monolithic elements or formworks for making raised and/or ventilated floors are known.

These monolithic plastic elements are generically dome-shaped with four legs and are positioned side by side and connected to one another in such a way as to form a continuous structure with a square mesh. The rod irons (for example, an electro-welded mesh or ribbed bars) making up the reinforcement are laid on said structure and the concrete mix is cast. A monolithic floor is thus obtained, which is ventilated on its underside and whose lower ventilation compartment can be used for laying pipes, ducts and cables.

Said monolithic modular elements for making raised and/or ventilated floors make it possible to obtain raised and/or ventilated floors with limited height with respect to the laying surface.

Modular elements whose corners rest on generically cylindrical or column-shaped elements are currently used for making raised and/or ventilated floors which are higher with respect to the laying surface.

The corner edge of these modular elements is shaped in such a way as to allow them to be coupled with the column-shaped elements in a stable manner.

The lower end of the cylindrical or column-shaped elements is housed in plane supporting elements which are suited to ensure that said cylindrical or column shaped elements are correctly rested on the underlying floor and that this operation is even improved, to maintain said cylindrical elements in vertical position, to maintain the lower ends of all the cylindrical elements in the correct position and correctly distributed on the underlying floor.

The patent document EP1605113B1 entitled "SYSTEM OF MODULAR ELEMENTS FOR MAKING RAISED AND/OR AERATED REINFORCED CONCRETE FLOORS", filed by the same applicant which is filing this patent application, describes a system for making raised and/or ventilated floors using plane supporting elements.

The known plane supporting elements comprise

- a cylindrical portion inside which the end of the cylindrical or column-shaped elements is accommodated, several generically vertical projections located inside said cylindrical portion and suited to maintain the lower end of the cylindrical or column-shaped elements centered inside said cylindrical portion, several lateral connection elements and/or portions suited to mutually constrain several plane supporting elements to one another in the correct positions and at the correct distances.

The known plane elements pose several drawbacks.

The known plane supporting elements are stackable, but when they are stacked they form a pile with considerable overall vertical dimensions.

A large amount of plastic material is needed for the production of the known plane supporting elements, in particular for making the cylindrical portion that accommodates the lower end of the cylindrical or column-shaped elements.

SUMMARY

The subject of the present patent application is a new supporting element for cylindrical or column-shaped elements of modular elements for making raised and/or ventilated floors.

It is an object of the present invention to provide a new supporting element that can be stacked on other supporting elements while maintaining smaller overall vertical dimensions than the known supporting elements.

It is another object of the present invention to provide a new supporting element that can be constructed using a smaller amount of plastic material.

These and other direct and complementary objects are achieved by the new modular supporting element for making raised and/or ventilated floors on columns. The new modular supporting element comprises:

- a substantially plane base, suited to be rested on the underlying floor,
- a first series of projections arranged along a circle and suited to define the seat in which the lower end of the cylindrical or column-shaped elements is inserted and housed,
- a second series of projections arranged along a circle that is concentric with the circle defined by said first series of projections and suited to adhere to the internal circular surface of the cylindrical or column-shaped elements,
- two or more lateral extensions, arranged at the sides of said plane base and coplanar with said plane base,
- male and female mutual coupling elements arranged on the parts of said lateral extensions that are far from said plane base,
- holes or openings provided on said plane base, both between each pair of consecutive projections of said first series and between each pair of consecutive projections of said second series, whose size is suited to allow the passage of identical projections of an identical modular supporting element positioned underneath.

The first and the second series of projections arranged on two concentric circles constitute, together with the plane base, the seat in which the lower end and the lower portion of said cylindrical or column-shaped elements are inserted and housed.

More specifically, each projection of the first series and each projection of the second series are aligned along the same radius, in such a way as to constitute a constrained housing for the lower edge of said cylindrical or column-shaped elements.

The height of said projections is suited to maintain the lower end of said cylindrical or column-shaped elements in position, and their cross section is suited to resist to the stress transmitted by said cylindrical or column-shaped elements.

According to the preferred embodiment, said projections of said first and second series have a generically T-shaped horizontal cross section with the first side, corresponding to the horizontal bar of the "T" shape, facing towards the seat that accommodates the cylindrical or column-shaped elements, and with the second side, corresponding to the vertical bar of the "T" shape, arranged externally to said seat accommodating the lower end of said cylindrical or column-shaped elements. Said lateral extensions are arranged at the sides of said base and are joined to said base.

Said lateral extensions are arranged radially with respect to the seat that accommodates the cylindrical or column-shaped elements.

Said lateral extensions are preferably arranged around said base, forming a generically orthogonal angle.

According to the invention, said lateral extensions can be two or more, preferably three or four.

At the ends of said lateral extensions there are said male and female mutual coupling elements, which are suited to connect and constrain each new modular supporting element to identical adjacent modular supporting elements.

According to the invention, said coupling elements provided at each end of said lateral extensions can be all of the same type, for example all male or all female elements, so that they can be coupled with the matching coupling elements of a lateral extension of an identical modular supporting element arranged in a different manner.

Alternatively, always according to the invention, said coupling elements provided at each end of said lateral extensions can be complementary, for example some male elements alternating with some female elements, so that they can be coupled with the matching coupling elements of a lateral extension of an identical adjacent modular supporting element, independently of its position.

According to the invention, each one of said coupling elements can have the receiving and the coupling portion in the same shape, in such a way as to allow any coupling between two modular supporting elements arranged in any way with respect to each other, which can be obtained by simply eliminating the coupling portion of some coupling elements.

Said plane base is provided, both between each pair of consecutive projections of said first series and between each pair of consecutive projections of said second series, with holes or openings with size suited to allow the passage of identical projections of an identical modular supporting element positioned underneath.

BRIEF DESCRIPTION OF THE DRAWINGS

The characteristics of the new modular supporting element for making raised and/or ventilated reinforced concrete floors will be highlighted in greater detail in the following description, with reference to the drawings that are attached hereto by way of non-limiting example.

Figures from 1 to 9 show a first example of embodiment of the new modular supporting element.

DETAILED DESCRIPTION OF THE PREFERRED EMBODIMENTS

The new modular supporting element comprises a substantially plane base (B) suited to be rested on the underlying floor.

The new modular supporting element comprises, furthermore, a first series of projections (R1) arranged along a circle and suited to define the seat in which the lower end of the cylindrical or column-shaped elements is inserted and housed.

The new modular supporting element comprises also a second series of projections (R2) arranged along a circle that is concentric with the circle defined by said first series of projections (R1), and suited to adhere to the internal circular surface of the cylindrical or column-shaped elements.

The new modular supporting element comprises also two or more lateral extensions (E) arranged at the sides of said plane base (B) and coplanar with said plane base (B).

The new modular supporting element comprises, furthermore, mutual coupling elements (G', G") arranged on the parts of said lateral extensions (E) that are far from said plane base (B).

The first series of projections (R1) and the second series of projections (R2) are arranged along two concentric circles and constitute, together with the plane base (B), the seat in which the lower end and the lower portion of said cylindrical or column-shaped elements are inserted and housed.

Each projection of the first series (R1) is aligned with a corresponding projection of the second series (R2) along the direction defined by a radius of each of the two circles formed by the two series of projections (R1, R2).

The pairs of projections of the two series (R1, R2), one belonging to a series (R1, R2) and the matching one belonging to the other series (R2, R1), constitute a constrained housing for the lower edge of said cylindrical or column-shaped elements.

In the example illustrated above, the projections of the second series (R2), the innermost, are shorter than the projections of the first series (R1), the outermost.

All of said projections (R1, R2) have a generically T-shaped horizontal cross section, with the first side (RT, R2'), corresponding to the horizontal bar of the "T" shape, facing towards the matching projections (R2, R1), and with the second side (R1", R2"), corresponding to the vertical bar of the "T" shape, arranged so that it is diametrically opposite the matching projections (R2, R1).

Said lateral extensions (E) are arranged at the sides of said base (B) and are joined to the base (B) itself.

Said lateral extensions (E) are arranged radially with respect to the base (B) and are orthogonal to each other.

Figure 1:
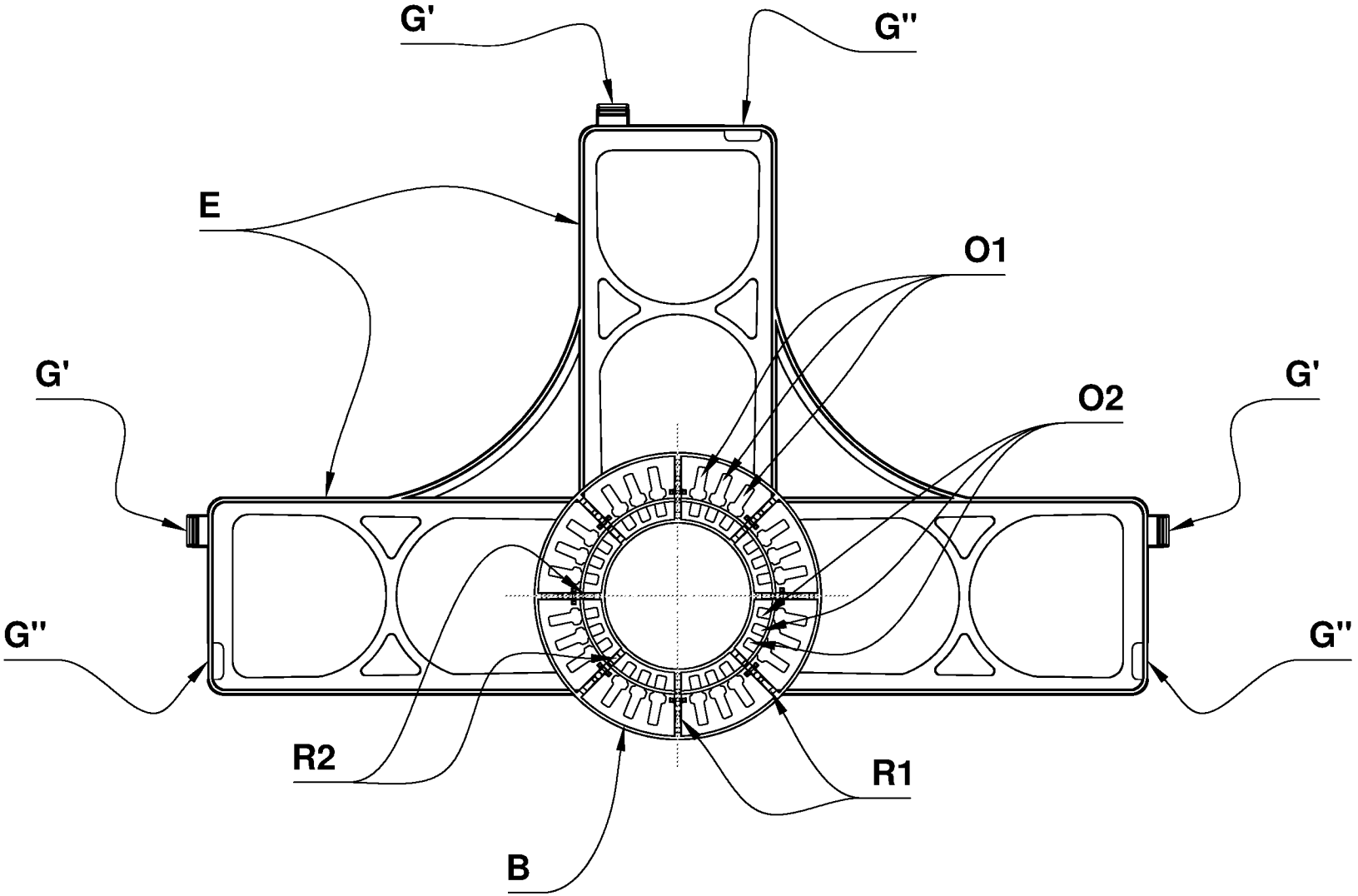
FIGS. 1, 2, 3 and 4 respectively show a plan view, an axonometric view and two details in axonometric view of the new modular supporting element.
Figure 2:
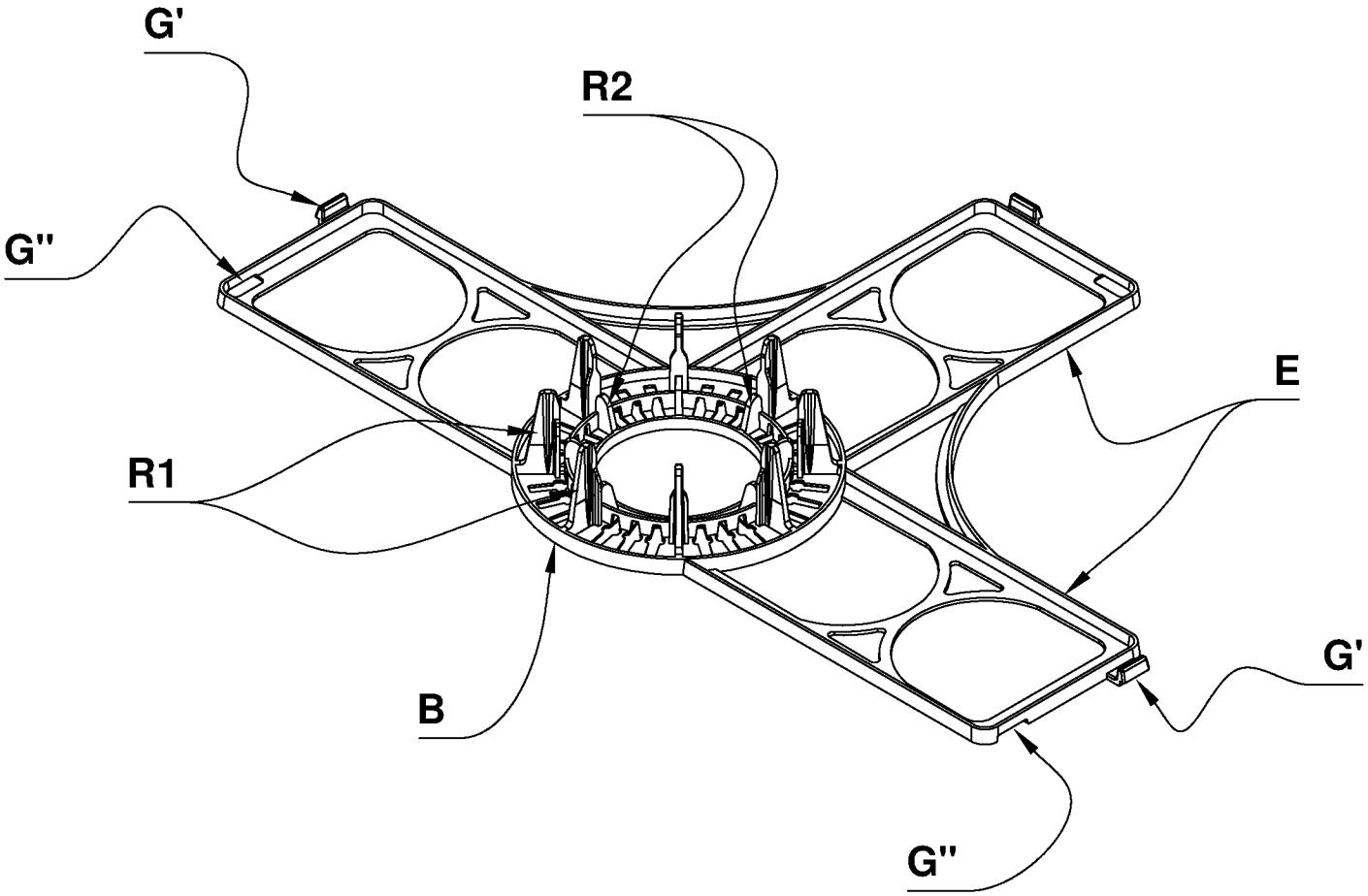
Figure 3:
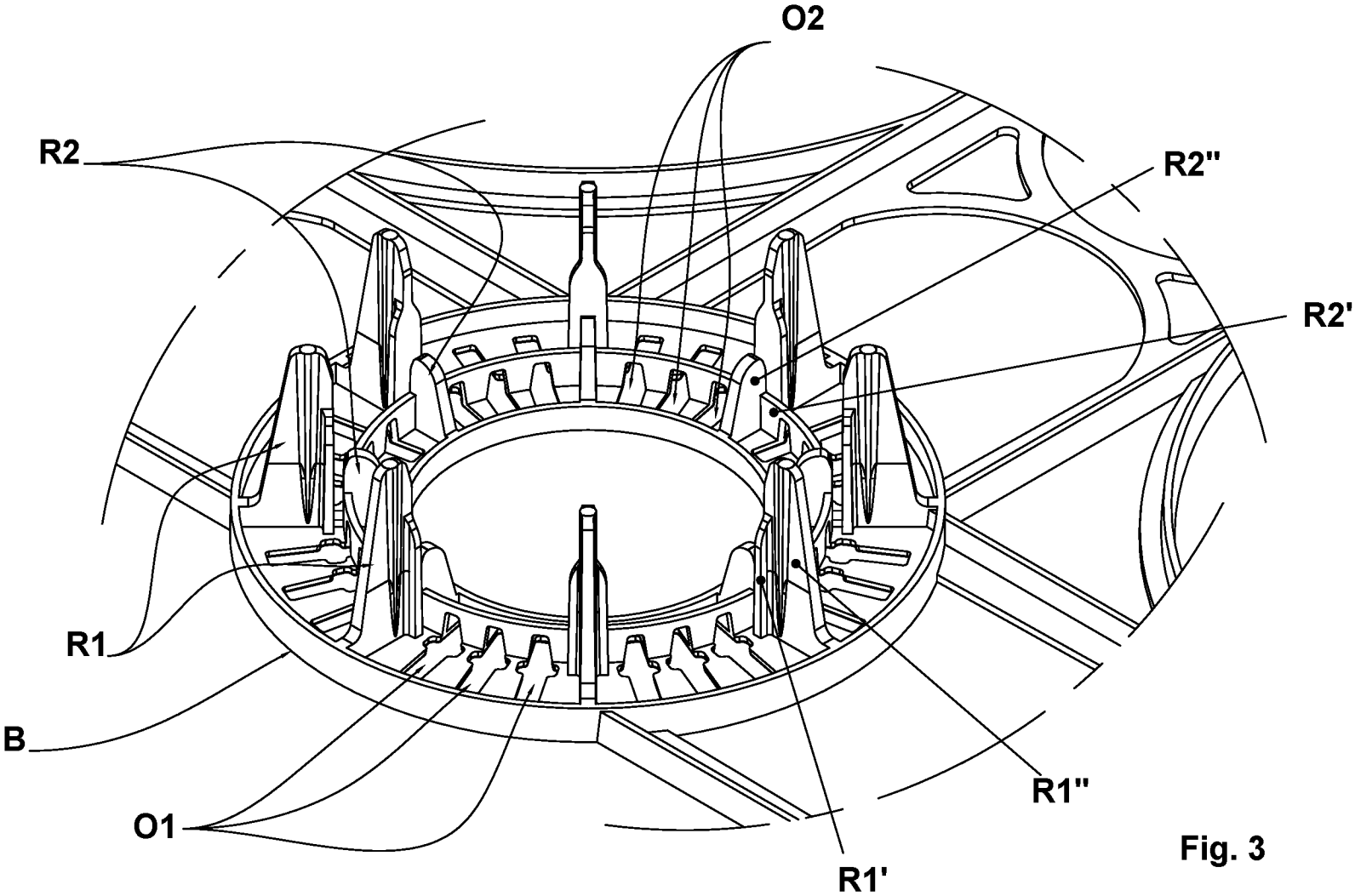

In the example shown in FIGS. 1, 2, 3, there are three lateral extensions (E) arranged according to a generic "T" shape.

Figure 4:
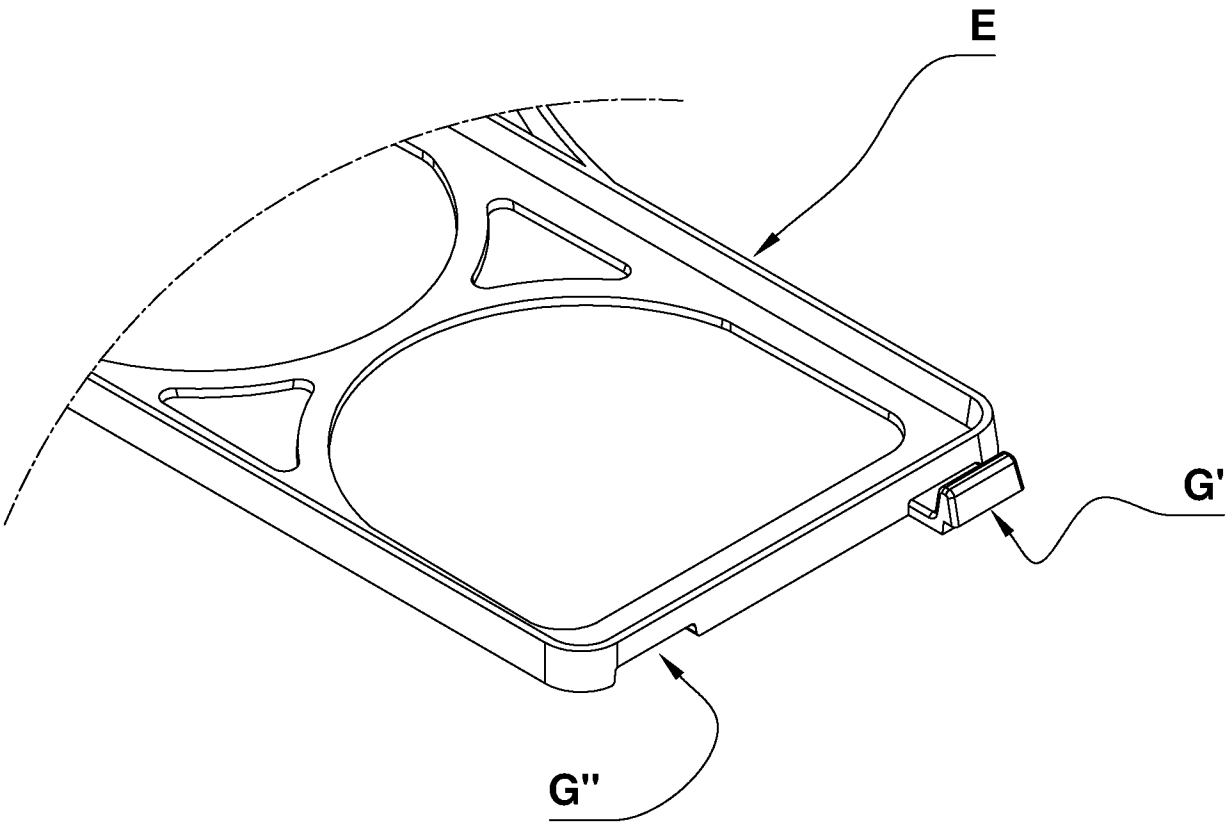

At the ends of said lateral extensions (E) there are said mutual coupling elements (G', G"), as shown in FIG. 4, suited to connect and constrain each new modular supporting element to identical adjacent modular supporting elements.

In this example, said mutual coupling elements (G, G") are constituted by seats (G") and by hook-shaped parts (G) which are suited to be mutually coupled and constrained to each other.

Figure 5:
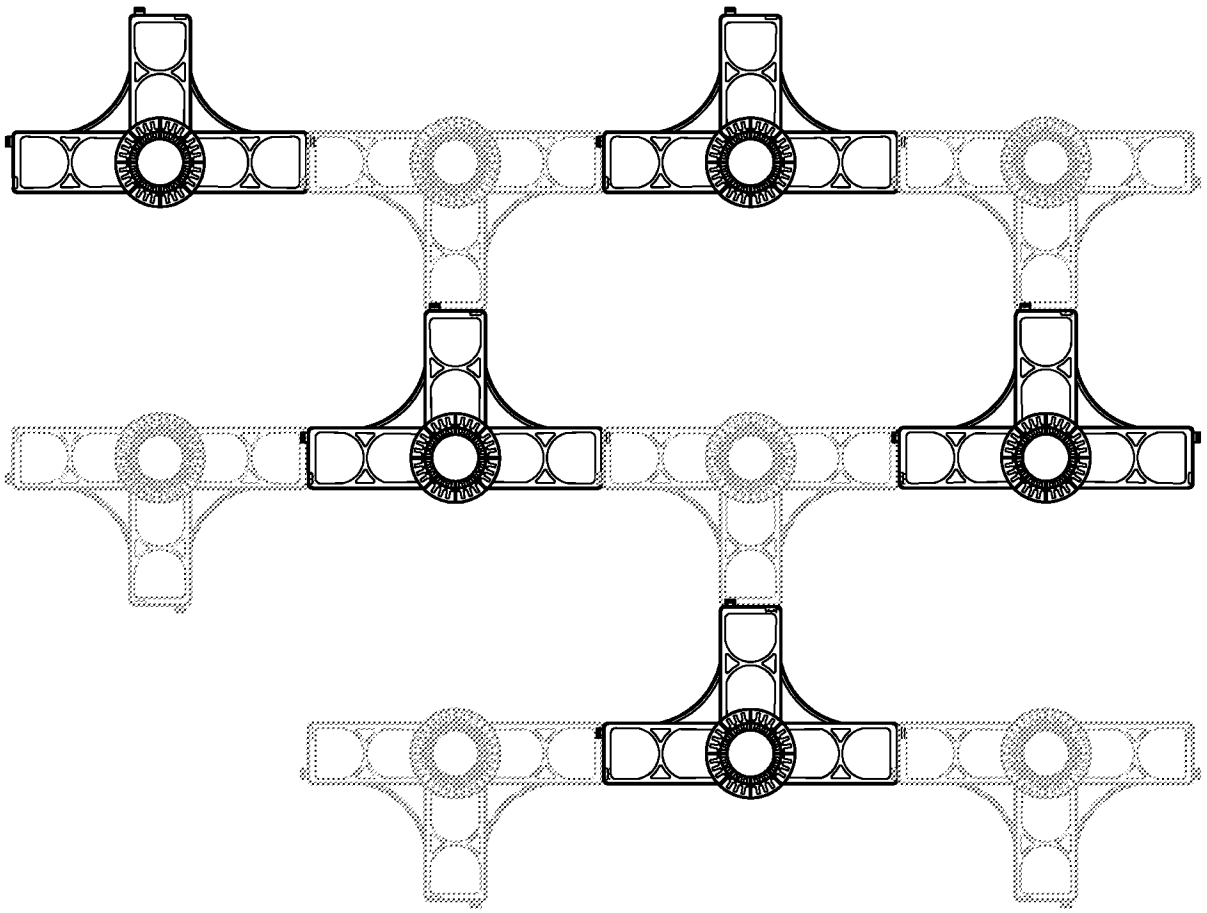
FIG. 5 depicts an array of the modular supporting elements interconnected to each other.

In the example illustrated herein, at the end of each lateral extension (E) there is a mutual coupling element in the form of a seat (G") and a mutual coupling element in the form of a hook (G). This configuration facilitates the connection of several new modular supporting elements with one another, as shown in FIG. 5.

Said plane base (B) is provided, both between each pair of consecutive projections (R1, R2) of said first series and between each pair of consecutive projections of said second series, with holes (O1, O2) or openings with size suited to allow the passage of identical projections (R1, R2) of an identical modular supporting element.

Figure 6:
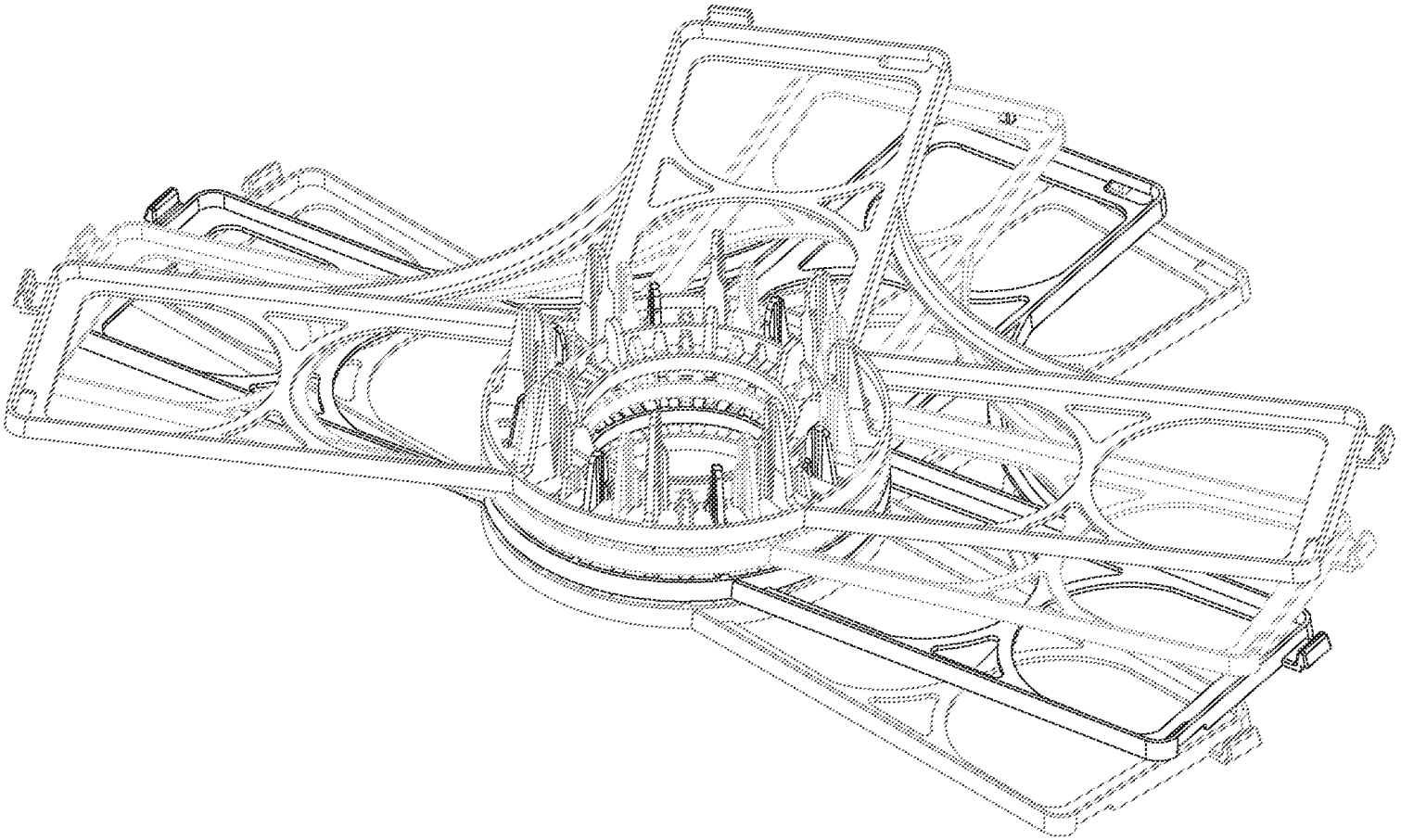
FIG. 6 depicts a plurality of the modular supporting elements stacked on each other.
Figure 7:
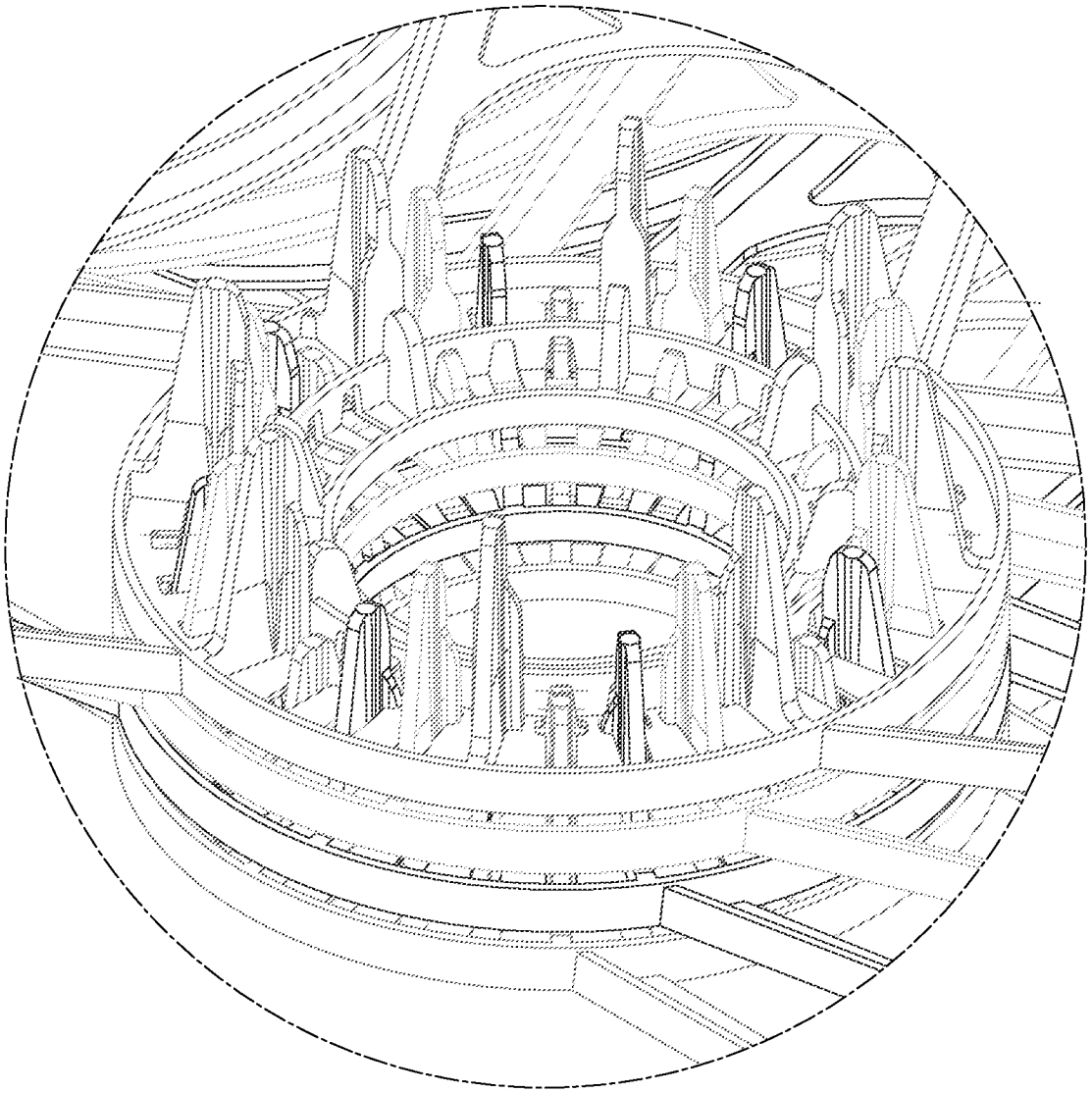
FIG. 7 is a detail of a portion of shown in FIG. 6.

When two or more new modular supporting elements are superimposed, said holes (O1, O2) allow the passage of the projections (R1, R2) of the underlying modular supporting elements, as illustrated in FIG. 6 and in the detail shown in FIG. 7. Said superimposition of two or more new modular supporting elements, with the projections (R1, R2) of the underlying modular supporting elements inserted in said holes (O1, O2) or openings of the overlying modular supporting elements, makes it possible to limit the overall vertical dimensions of the stacked new modular supporting elements.

Figure 8:
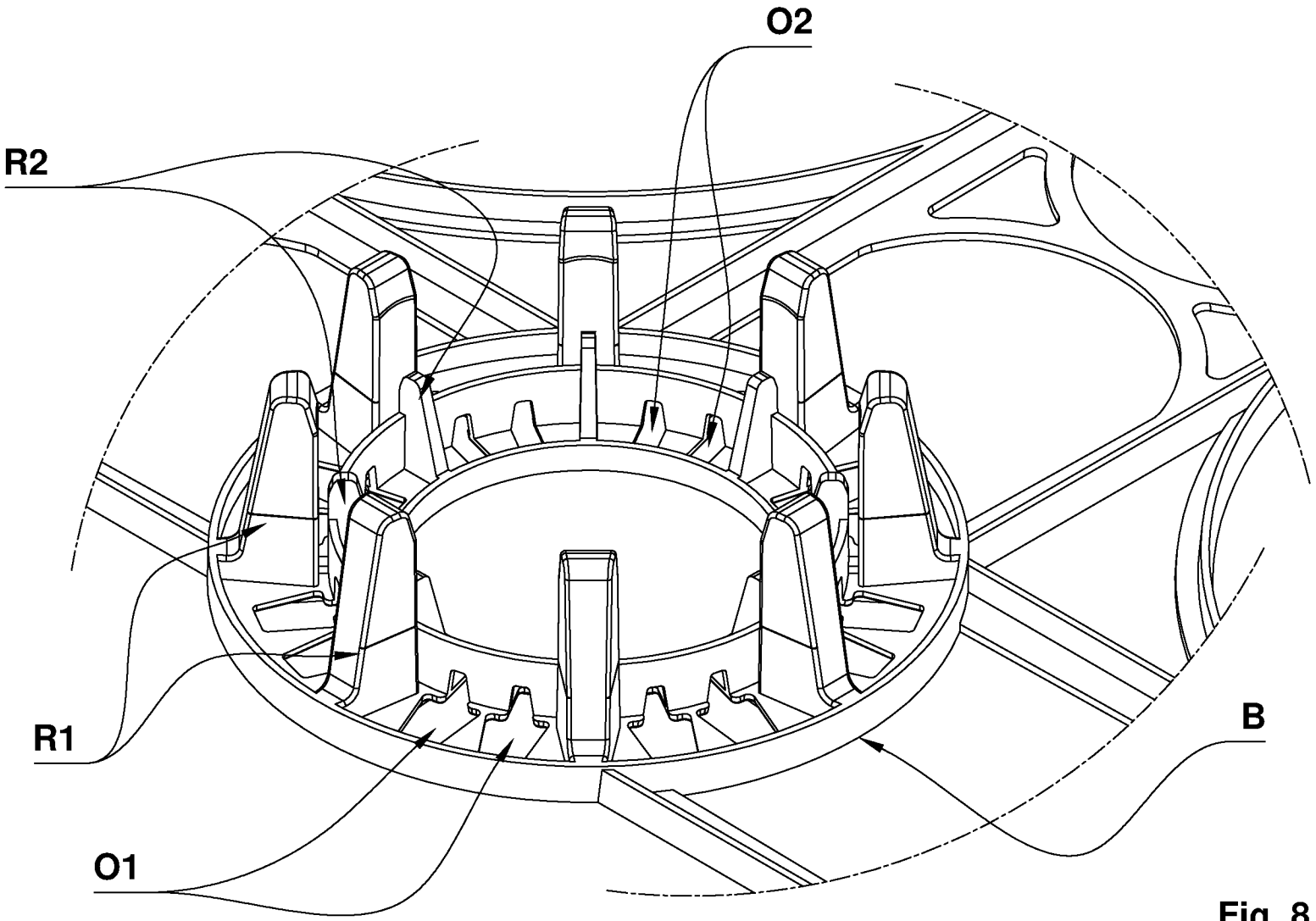
FIG. 8 is a detail of an alternate configuration.

FIG. 8 shows in detail a second example of embodiment of a modular supporting element in which said projections (R1, R2) are provided in a smaller number and with larger cross section, and the base (B) is provided with corresponding holes (O1, O2) or openings in a smaller number and with size suited to accommodate said projections (R1, R2) of said second example of embodiment.

Figure 9:
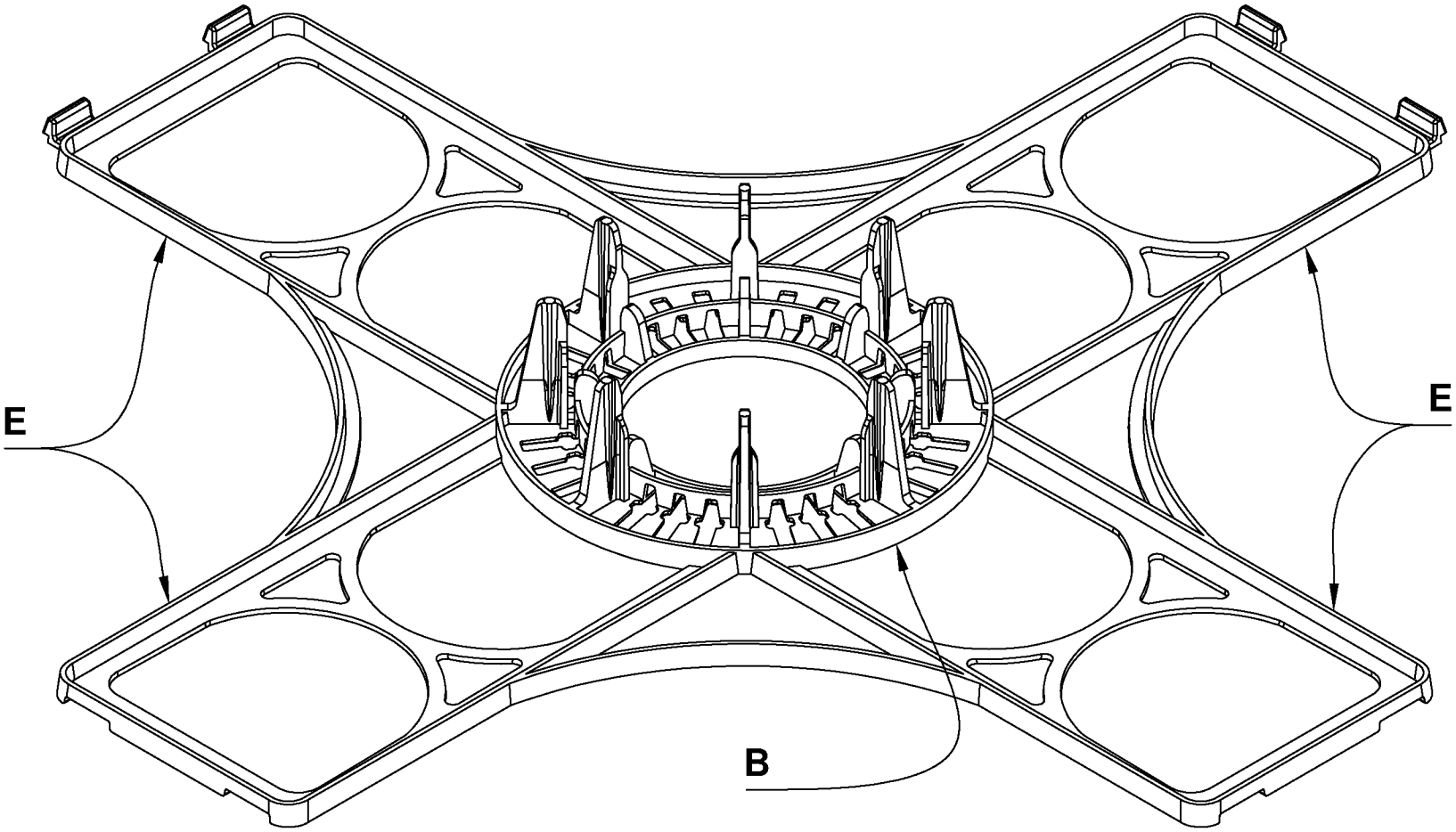
FIG. 9 shows an example of embodiment of the new modular supporting element having four lateral extensions (E) oriented according to four orthogonal directions.

FIG. 9 shows an example of embodiment of the new modular supporting element having four lateral extensions (E) oriented according to four orthogonal directions. FIGS. from 10 to 13 show a second example of embodiment of the new modular supporting element.

In this second example, on the parts of said lateral extensions (E) that are far from said plane base (B) there are coupling elements (F) suited to be coupled with the edge (E) of said lateral extensions (E) that is far from said plane base (B) of an identical modular supporting element.

Figure 10:
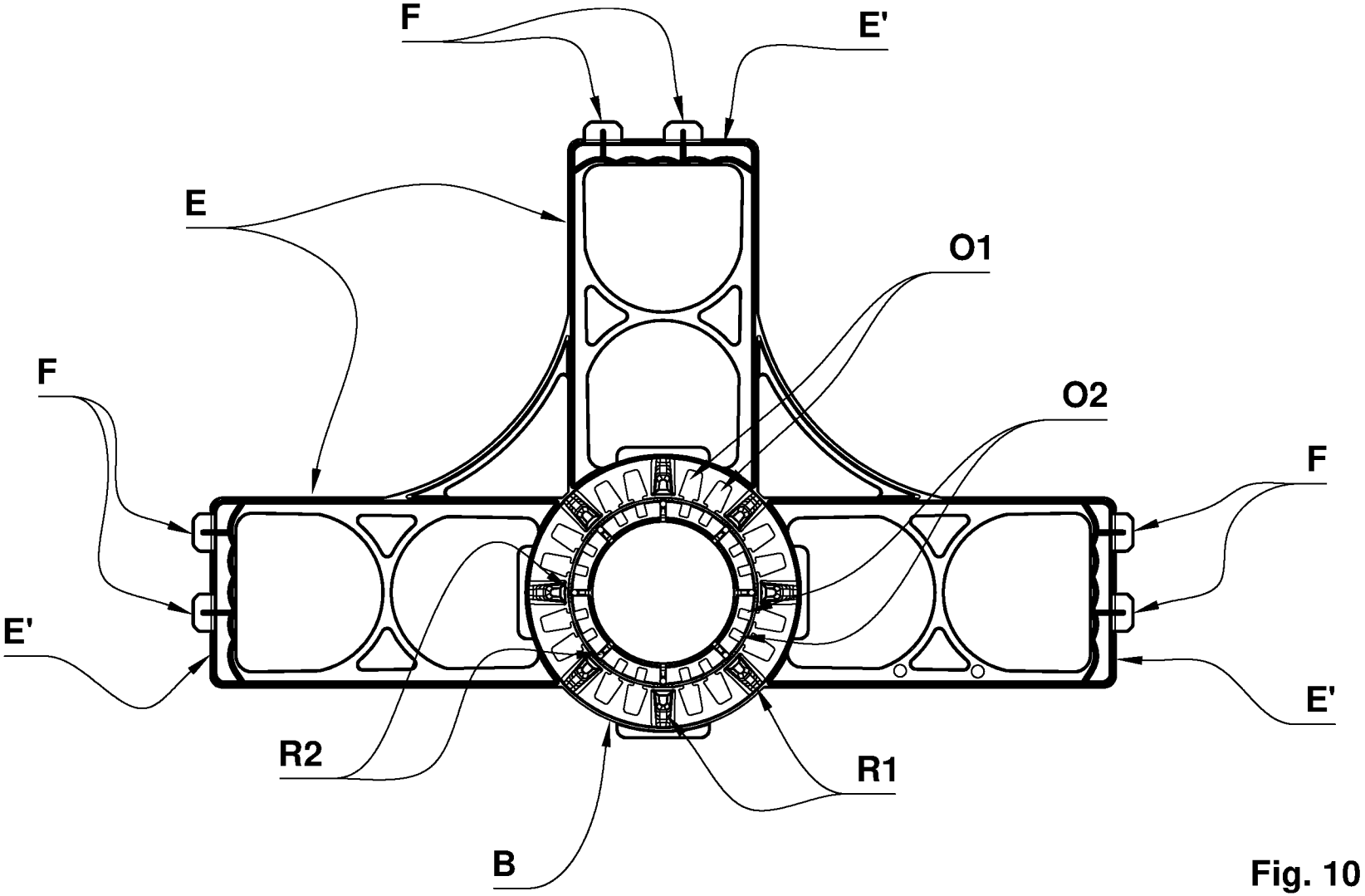
FIGS. 10 to 13 show a second example of embodiment of the new modular supporting element.
Figure 11:
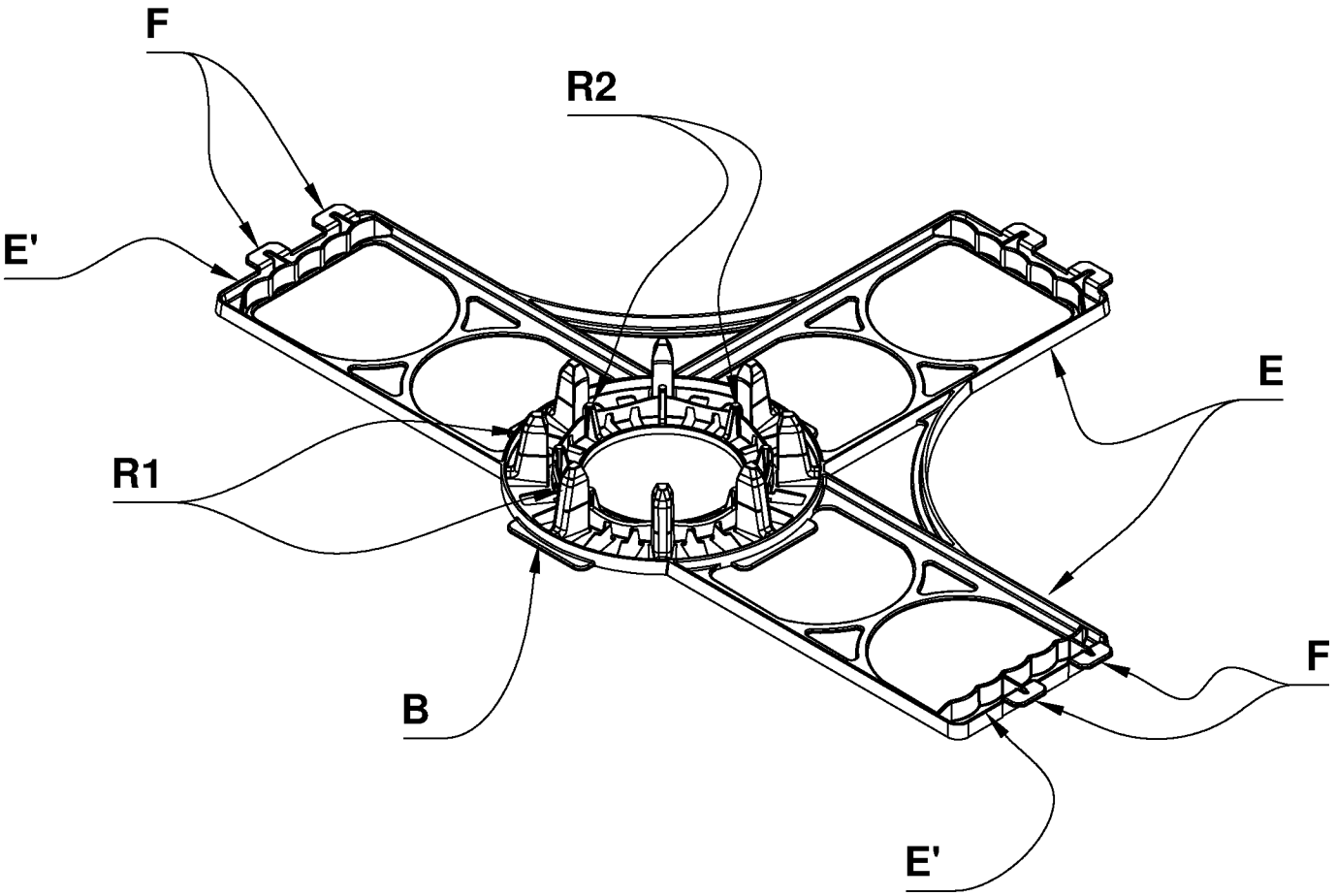

FIGS. 10 and 11 respectively show a plan view and an axonometric view of the second example of embodiment of the new modular supporting element.

Figure 12:
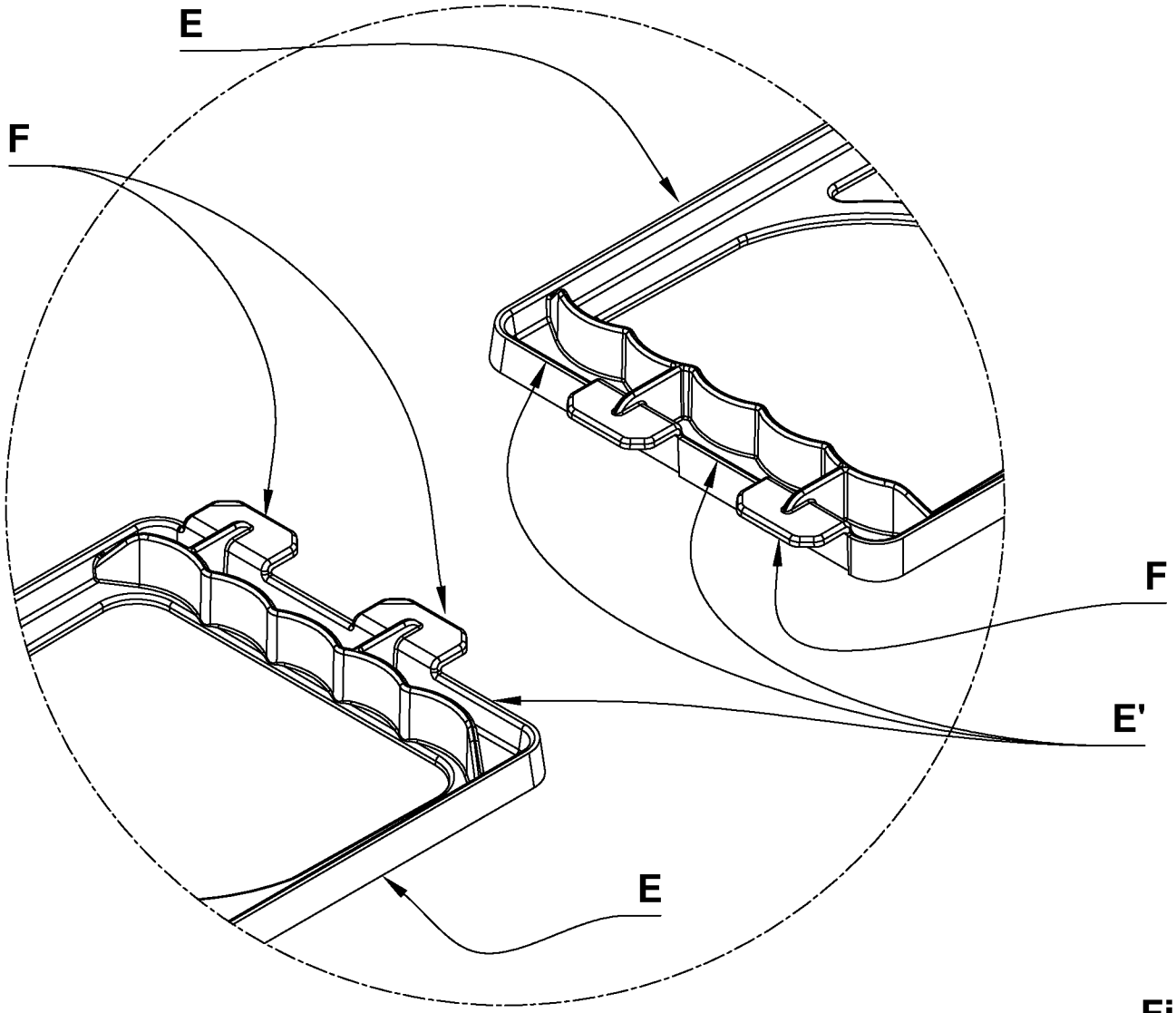
Figure 13:
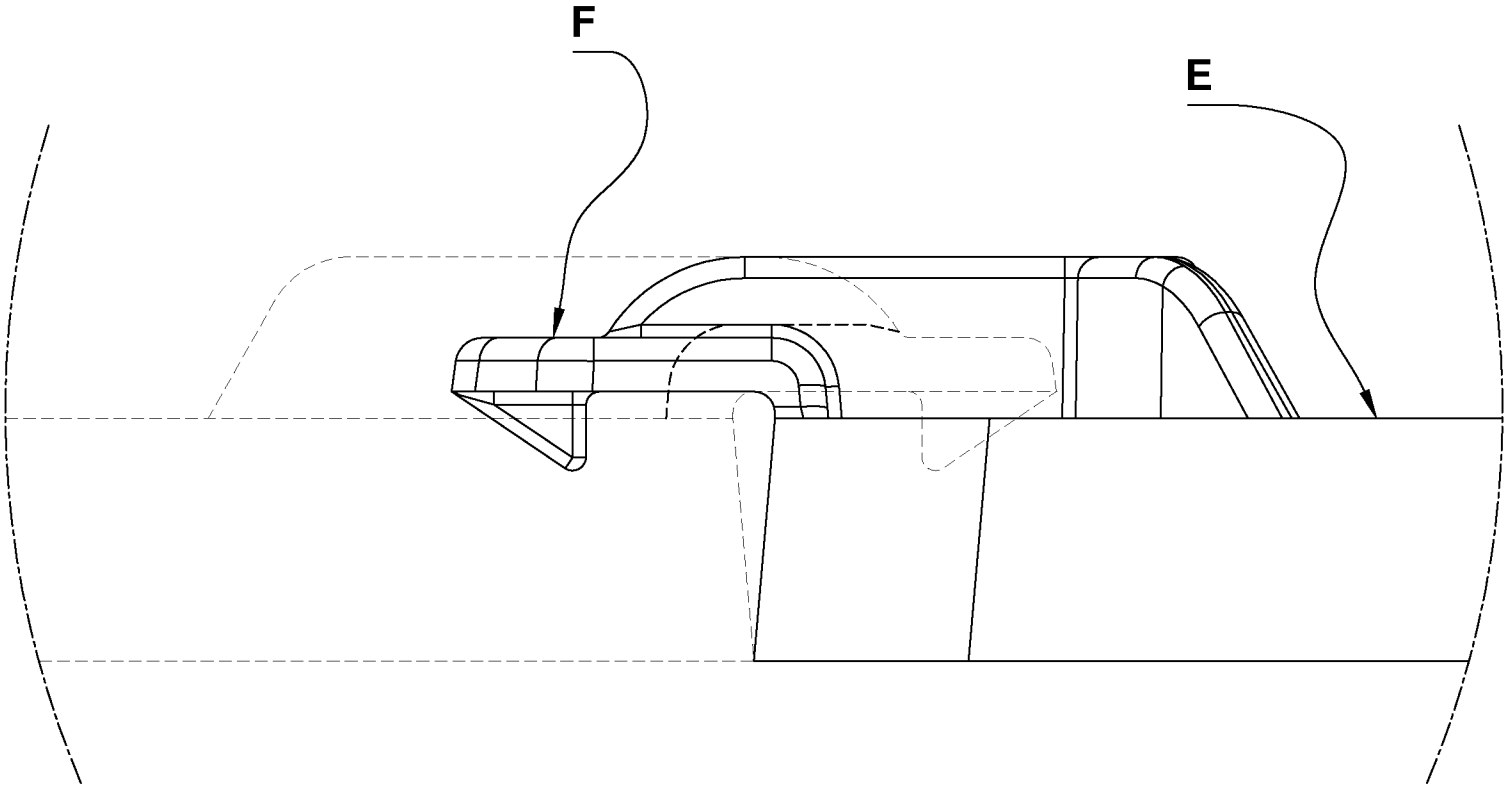

FIG. 12 shows the ends of the lateral extensions (E) that are far from said plane base (B) of two modular supporting elements before they are coupled with each other, while FIG. 13 shows a side view of two modular supporting elements coupled with each other. In FIG. 13, for the sake of clarity, one of the two modular elements is indicated by a broken line.

The new modular element is joined to other identical modular elements, each rotated by 180 degrees with respect to the adjacent elements, as shown in FIG. 5. These are the schematic outlines that are sufficient to the expert in the art to carry out the invention, consequently, upon implementation, variants may be developed which do not affect the substance of the innovative concept introduced herein. Therefore, with reference to the above description and the attached drawings, the following claims are expressed.

The invention claimed is:

1. A support element for cylindrical or column-shaped elements of modular elements for making raised and/or ventilated floors, comprising:

a base, comprising:

a flat first side configured to be rested on an underlying floor, and a second side opposite thereto, at least two lateral extensions arranged at sides of said base and coplanar with said base, and coupling elements arranged on the portions of said lateral extensions that are distal to said plane base, the support element further comprising: a first series of projections, each projection having a generally T-shaped horizontal cross section, the projections extending from said second side of said base and are arranged in a circle centered on said base; and second series of projections extending from said second side of said base, arranged in a circle and concentric with the first series of projections, defining a generally U-shaped seat between the first and second projections, the generally U-shaped seat dimensioned to matingly engage with a lower end of the cylindrical or column-shaped elements.

2. The support element according to claim 1, wherein said base is provided with holes or openings between each pair of consecutive projections of said first series, and wherein said holes are suited to allow identical projections of an identical support element to pass therethrough.

3. The support element according to claim 1, wherein said base is provided with holes or openings between each pair of consecutive projections of said second series, and wherein said holes or openings are suited to allow identical second series projections of an identical support element to pass therethrough.

4. The support element according to claim 1, wherein each projection of the first series is aligned with a corresponding projection of the second series along the direction defined by a radius of each of the two circles defined by the two series of projections.

5. The support element according to claim 1, wherein each projection of both the first series and the second series has a general T-shaped horizontal cross section with a first side, which corresponds to the horizontal bar of the "T" shape, facing towards a matching projections, and with a second side, which corresponds to the vertical bar of the "T" shape, arranged in the diametrically opposite position with respect to the matching projections.

6. The support element according to claim 1, wherein said projections of the first series have a greater height than said projections of the second series.

7. The support element according to claim 1, wherein said coupling elements are matching male and female elements, so that each coupling element is engageable with a corresponding respective coupling element.

8. The support element according to claim 7, wherein each one of said coupling elements is provided with both a male and a female coupling portion, and wherein the male coupling portion can be broken and removed, in such a way as to allow the coupling element to become engaged with the corresponding male or female portion of another coupling element.

9. The support element according to claim 1, wherein said coupling elements are engageable with an edge of said lateral extensions that is distal to said plane base of an identical support element.

* * * * *